US009932931B2

(12) United States Patent
Jones et al.

(10) Patent No.: US 9,932,931 B2
(45) Date of Patent: Apr. 3, 2018

(54) COMPOSITE CYLINDER BLOCK OF AN I.C. ENGINE

(75) Inventors: Steve Jones, Warwick (GB); Graham Page, Stratford upon Avon (GB); Ian Shilling, Banbury (GB)

(73) Assignee: Jaguar Land Rover Limited, Whitley, Coventry, Warwickshire (GB)

( * ) Notice: Subject to any disclaimer, the term of this patent is extended or adjusted under 35 U.S.C. 154(b) by 0 days.

(21) Appl. No.: 13/885,831

(22) PCT Filed: Nov. 16, 2011

(86) PCT No.: PCT/EP2011/070263

§ 371 (c)(1),
(2), (4) Date: Oct. 8, 2013

(87) PCT Pub. No.: WO2012/066041

PCT Pub. Date: May 24, 2012

(65) Prior Publication Data

US 2014/0026841 A1 Jan. 30, 2014

(30) Foreign Application Priority Data

Nov. 16, 2010 (GB) ..... 1019356.3

(51) Int. Cl.
*F02F 7/00* (2006.01)
*F02F 1/10* (2006.01)

(52) U.S. Cl.
CPC ..... *F02F 7/00* (2013.01); *F02F 1/108* (2013.01); *F02F 7/0007* (2013.01); *F02F 7/0053* (2013.01)

(58) Field of Classification Search
CPC ..... F02F 1/00; F02F 2200/06; F02F 7/0021
USPC ..... 123/195 R, 193.5, 193.1, 193.2
See application file for complete search history.

(56) References Cited

U.S. PATENT DOCUMENTS 688,652 A * 12/1901 Krug ..... G03B 1/56 242/355
2,395,766 A 2/1946 Schreck
3,064,634 A * 11/1962 Tyce et al. ..... 123/41.74
4,630,579 A * 12/1986 Atkin ..... F02F 7/0053 123/195 H
4,930,470 A 6/1990 Kabat et al.
5,083,537 A * 1/1992 Onofrio ..... F02F 1/108 123/195 C (Continued)

FOREIGN PATENT DOCUMENTS

CN 101666274 A 3/2010
CN 103380284 A 10/2013

(Continued)

OTHER PUBLICATIONS

Great Britain Search Report for corresponding application No. GB1019356.3, dated Jun. 24, 2011, 1 page.

(Continued)

*Primary Examiner* — Long T Tran
(74) *Attorney, Agent, or Firm* — Reising Ethington P.C.

(57) ABSTRACT

A composite cylinder block comprises an inner component defining one or more cylinder bores and main bearing supports of a crankshaft, and an outer component defining an upper crankcase, the inner component being inserted in the outer component, and being rigidly attached thereto. The arrangement provides a comparatively lightweight and rigid cylinder block.

19 Claims, 4 Drawing Sheets

(56) References Cited

U.S. PATENT DOCUMENTS

| | | | | |
|---|---|---|---|---|
| 5,611,301 | A | 3/1997 | Gillbrand et al. | |
| 6,237,558 | B1 * | 5/2001 | Ergezen et al. | 123/195 R |
| 6,543,405 | B2 * | 4/2003 | Sachdev | F01B 1/12 123/195 R |
| 6,880,513 | B1 * | 4/2005 | Komatsu | F02F 1/102 123/195 R |
| 6,886,522 | B1 * | 5/2005 | Lawrence | F02F 1/40 123/195 R |
| 6,945,214 | B2 * | 9/2005 | Sachdev | F02F 7/0031 123/195 R |
| 6,973,907 | B2 * | 12/2005 | Satou | F02B 75/20 123/193.2 |
| 7,146,724 | B2 * | 12/2006 | Millerman | B23P 19/043 29/222 |
| 7,322,320 | B2 * | 1/2008 | Sugano | F02F 1/36 123/41.72 |
| 8,020,528 | B1 * | 9/2011 | Phillips | F01M 11/0004 123/192.1 |
| 2005/0076862 | A1 * | 4/2005 | Satou | F02B 75/20 123/41.74 |
| 2005/0166395 | A1 * | 8/2005 | Millerman | B23P 19/043 29/888.01 |
| 2008/0245320 | A1 * | 10/2008 | Ishikawa | F02F 1/10 123/41.74 |
| 2010/0050977 | A1 * | 3/2010 | Park | F02F 7/0085 123/195 R |
| 2010/0059014 | A1 * | 3/2010 | Sicre | F02F 7/0053 123/195 H |

FOREIGN PATENT DOCUMENTS

| | | | |
|---|---|---|---|
| DE | 4306269 | A1 | 2/1994 |
| DE | 102005041340 | A1 | 3/2007 |
| EP | 2640950 | A1 | 9/2013 |
| GB | 1019730 | A | 2/1966 |
| GB | 2485542 | A | 5/2012 |
| JP | S5529022 | A | 3/1980 |
| JP | S60150463 | A | 8/1985 |
| JP | S6269044 | U | 4/1987 |
| JP | S62131952 | A | 6/1987 |
| JP | H10169503 | A | 6/1998 |
| JP | H11223153 | A | 8/1999 |
| WO | WO2012066041 | A1 | 5/2012 |

OTHER PUBLICATIONS

International Search Report for PCT/EP2011/070263 dated Mar. 13, 2012, 4 pages.

Written Opinion for PCT/EP2011/070263 dated Mar. 13, 2012, 4 pages.

English Translation of Chinese Office action corresponding to application No. 201180661171.X, dated Sep. 16, 2015, 11 pages.

* cited by examiner

COMPOSITE CYLINDER BLOCK OF AN I.C. ENGINE

FIELD OF THE INVENTION

The present invention relates to a cylinder block for an engine, for example a conventional reciprocating piston internal combustion engine, and particularly, but not exclusively, to a composite cylinder block in which the component parts are better adapted to functional requirements. Aspects of the invention relate to a cylinder block, to an engine, to a vehicle and to a method.

In some embodiments, the term 'cylinder block' is defined as the cylinder or barrel in combination with the upper crankcase. For convenience a multi-cylinder in-line cylinder block is described, though the invention is applicable to single cylinder and non in-line configurations.

BACKGROUND

Composite cylinder blocks are known. For example the cylinders may be constituted by a component bolted to a separate upper crankcase. Alternatively the individual cylinders may comprise liners pressed into a block/crankcase jacket. More recently it has been proposed to cast a crankcase jacket onto a core defining the cylinders to form a unitary component. These techniques have generally been adopted to allow lightweight materials to reduce cylinder block mass, typically by providing for iron cylinders and a jacket/crankcase of aluminium alloy. Reduction in cost and ease of machining may also be important factors.

A composite cylinder block may have many advantages of performance in addition to economy of mass production. However costs of machining and assembly may be increased, along with some risk of reduced reliability consequent upon the multiple components.

Whatever method of production, a cylinder block is generally designed to have lowest possible mass and is accordingly narrow in the direction transverse to the cylinder bore. Low mass has benefits of low cost and easier materials handling. In a unitary cylinder block, the runners linking the cylinders to the outer face tend to have a large volume for reasons of good casting technique—in consequence the ribs which remain after casting have a much larger volume, and thus weight, than is required for strength and intended duty. A narrow cylinder block is preferred to reduce the volume of such ribs to a minimum, but the passages connecting the internal spaces are somewhat tortuous so that windage losses are increased.

Refinement of engine operation is essential in modern vehicles so as to reduce the transmission of noise and vibration to the occupants. This can be achieved to some extent by stiffening the cylinder block, or by using stronger materials. These solutions also tend to increase cost because a relatively stiff block may require additional mass, and strong materials tend to be expensive to form, and to machine.

What is required is a cylinder block which can provide a relatively stiff, low mass component, using low cost materials where possible, yet avoiding narrow internal spaces.

It is an aim of the present invention to address this issue and to improve upon known technology. Embodiments of the invention may provide a cylinder block for an engine which improves manufacturability without compromising performance and reliability or increasing cost. Other aims and advantages of the invention will become apparent from the following description claims and drawings.

SUMMARY OF THE INVENTION

Aspects of the invention therefore provide a cylinder block, an engine, a vehicle and a method as claimed in the appended claims.

According to one aspect of the invention for which protection is sought, there is provided a composite cylinder block for a reciprocating piston internal combustion engine, the block comprising an inner component defining a cylinder bore and defining, at least in part, main bearing supports for a crankshaft, and an outer component defining an upper crankcase, the inner component being inserted in the outer component and being rigidly attached thereto.

In an embodiment the inner component is spaced from the outer component with a substantial air gap other than at the attachment location(s).

The main bearing supports comprise the principal means by which the crankshaft is supported in relation to the cylinders, and typically consist of the cylinder side of split housing main bearings. The main bearings are provided on either side of the cylinder bore.

Direct or indirect rigid attachment is envisaged. The composite cylinder block may further include a linking component. In one embodiment the linking component may comprise a cylinder head of an engine or a bed plate comprising the main bearing caps. Such a bed plate may comprise a unitary casting, or a composite unitized component comprising one material for the main bearing caps and another material for the remainder of the bed plate. In one example cast iron bearing caps may be cast into a ladder frame of aluminium alloy.

In one embodiment the inner component is substantially unitary, that is to say formed homogeneously of one material, for example cast iron. In an other embodiment the inner component is unitized and may comprise a cast iron liner pressed or cast into a jacket of e.g. aluminium alloy. In one embodiment the outer component is substantially unitary, that is to say formed homogeneously of one material, for example aluminium alloy.

In one embodiment, the inner and outer components are adapted for rigid attachment by welding. Accordingly the components may define a clearance for receiving a deposition weld. The deposition weld may extend substantially along a peripheral clearance between the inner and outer components, for example adjacent the cylinder head plane.

In an embodiment, the joining of the inner and outer components may be achieved during casting. For example, a first one of the inner and outer components may initially be cast, and then the other one of the inner and outer components may be cast and joined or fused to the first component during the casting process.

In another embodiment, the inner and outer components are adapted for rigid attachment by screw-threaded fasteners. The fasteners are preferably provided at touching points of the inner and outer components. Alternatively the inner and outer components may be held in rigid relationship via a linking component, such as a cylinder head or bed plate, attached by screw-threaded fasteners.

In one embodiment the inner component is a press-fit into the outer component. The inner component may define a plurality of outwardly extending bosses for press-fit engagement with corresponding faces of the outer component. Such bosses may be provided on either side of the center line of the inner component (thus extending transversely) and/or at the opposite ends (thus extending in the direction of the crank axis of rotation). Such bosses may be provided in upper and/or lower planes, for example substantially at the crankshaft bearing supports and adjacent the combustion chamber end of the cylinder bore. The main bearing caps may be provided individually or in a bed plate. In either case the main bearing caps or bed plate may be provided with outwardly extending bosses for press fit engagement with corresponding faces of the outer component.

Bosses for providing an interference fit may be provided on the outer component additionally or in substitution for bosses of the inner component. Mechanical fixings, for example bolts, may extend between the inner and outer components in the immediate region of the interference fitting, and in one embodiment directly in or through said bosses.

The outer component may extend below the crankshaft center line, for example in the form of a skirt. The skirt may be circumferentially continuous and include an access opening for a crankshaft at the flywheel end/transmission end thereof.

The inner component may define a water jacket for the cylinder. In one embodiment the water jacket is formed homogeneously, in for example cast iron, and has supply and return paths from a cylinder head. The water jacket may extend about the upper part of the cylinder only, for example around the working volume of the cylinder.

According to another aspect of the invention for which protection is sought, there is provided a method of assembling an engine utilizing a composite cylinder block of the preceding aspect, the method comprising machining the inner component to substantially finished form, assembling piston, connecting rod and crankshaft to the inner component, machining the outer component to substantially finished form, inserting the assembled inner component in the outer component; and rigidly connecting the inner and outer components.

The assembly order of this method is non-traditional, but has the advantages that the inner component is lighter and thus easy to handle. Furthermore internal and external moving parts may be attached to the inner component prior to attachment of the outer component.

According to a further aspect of the invention for which protection is sought, there is provided a method of making a composite cylinder block according to a preceding aspect, and comprising machining the inner component to substantially finished form, machining the outer component to substantially finished form, inserting the inner component in the outer component and rigidly attaching the inner component to the outer component.

According to a still further aspect of the invention for which protection is sought, there is provided a method of making a composite cylinder block according to a preceding aspect, and comprising machining the inner component to partially finished form, machining the outer component to partially finished form, inserting the inner component in the outer component, rigidly attaching the inner component to the outer component to define an assembly and machining the assembly to substantially finished form.

In these arrangements certain critical dimensions and planes can be machined after attachment of the inner and outer components, so as to avoid introduction of variability upon assembly of fully machined components.

These methods of manufacture may include attachment of a linking component, such as a cylinder head or bed plate, for the purpose of finish machining. For example a bed plate may be attached to permit line boring of the main bearing housings.

The method may include the further step of rigidly attaching the inner and outer component by welding.

At least certain implementations of the invention permit the cylinder and main bearing supports to be optimized by a high strength, high specification material. Preferably the inner and outer components are each formed substantially in one piece, for example by molding, casting or die casting, and are each of a homogenous raw material.

The inner component may be defined by a cylinder portion defining the cylinder bore, and a main bearing portion defining main bearing supports on either side of the cylinder bore axis. In a preferred embodiment, the outer component is rigidly attached at the cylinder portion, for example by the cylinder head. Preferably the cylinder head is screwed to the inner and outer components so as to unify them at the plane of the cylinder head gasket. The cylinder portion may have no transverse abutment to the outer component, in particular where the cylinder head links the inner and outer components. Similarly a bed plate may unify the inner and outer components at the split plane of the main bearings of the crankshaft.

In one embodiment the cylinder head is attached to the inner component and to the outer component, for example by screw-threaded fastenings. The cylinder head may be dowelled, in particular a plurality of dowels may extend between the cylinder head and the inner component. In one embodiment the cylinder may seat in a respective circular recess of the cylinder head.

The cylinder head may comprise a water jacket for the cylinder, in particular for the upper part thereof, for example the upper 60% thereof adjacent the combustion chamber. In one embodiment the water jacket for the cylinder comprises a close fitting, annulus incorporating internal coolant channels. Such an arrangement obviates the possibility of coolant leaks at the cylinder head jointing face. The coolant channels may extend between adjacent cylinders of a multi-cylinder engine.

The torque reaction path to the outer component is preferably from the main bearing portion, so as to relieve the cylinders of resisting crankshaft torque, and this path may be constituted by physical contact of the main bearing portion and outer component, or via a rigid connection comprising screws or cross bolts; or via a bed plate. The inner component may be directly supported by the outer component to resist transverse piston thrust.

The unitary inner component allows more accurate position and alignment of cylinder bore center and crankshaft center line than would be possible with an assembly of separate components. The main bearing supports typically comprise machined semi-circular housings adapted to receive semi-circular shell bearings, and for which mating caps are provided. The main bearing caps may be formed as part of the inner component, and divided therefrom by any suitable method. The caps may unitized in a bed plate.

Alternatively the main bearing supports may each comprise a circular housing, for example to receive a built-up crankshaft with rolling element main bearings.

The inner component preferably has a lattice-like form with apertures in places of low stress, so as to confine material to the functional duty associated with cylinders and main bearings. In particular the inner component need not confine splashing or churning lubricant.

The outer component defines a substantially continuous external wall of the engine, at least along the lateral flanks thereof. This wall acts to retain lubricant and crankcase gases, and to keep the internal parts of the engine clean.

The outer component is typically of a different specification adapted to external features, such as the functions of engine mounting, and clutch housing.

The inner and outer components may be of the same grade of the same material, in which case the invention provides for manufacturing and machining options not possible in a conventional unitary cylinder block. For example a greater variation is wall thickness may be possible, or apertures as mentioned above. Access is improved for machining of the external surface of the inner component, and the internal surface of the outer component. For example mountings and bearing supports of moving parts mounted on the exterior of the inner component can be relatively easily machined.

The inner and outer components may be of different grades of the same material, so as to allow the inner component to be of a comparatively high strength material for resisting combustion and reciprocating loads.

As a further alternative the inner and outer components may be of significantly different materials, such as iron and aluminium, so as to optimize function, machinability and appearance. Thus a die cast outer component of aluminium may have substantially greater options for functional and aesthetic design than a cast-iron outer component, by virtue of the manufacturing techniques associated with pressure die casting. Where different materials are used, differential expansion must be accommodated by design features.

The inner component may include functional features directly associated with the necessary high specification material, such as bearings for other rotating components. The outer component may extend below the crankshaft center line and/or above the crankcase so as to at least partially envelope the cylinders. In the preferred embodiment the inner component is wholly within the outer component.

The composite cylinder block of the invention typically has considerably less mass, up to 50% less, than a substantially unitary component according to the prior art. Typically a composite four cylinder engine block of aluminium and cast iron according to the invention may weigh around 19 kg, compared with 36 kg for a unitary engine block of cast iron. This reduced mass has numerous benefits, not least associated with handling and machining of the raw component parts.

A further advantage that may be achieved by at least some implementations of the invention relates to engine families, particularly where gasoline and diesel derivatives are proposed of identical cylinder count and similar power and/or torque output. Ideally such engine families should have similar dimensions and hard points so as to facilitate assembly of variants of a motor vehicle with minimum differences.

Fewer cylinders could however be provided in derivatives having a common outer component, thus leaving a greater internal space between the inner and outer components.

According to embodiments of the invention an outer component common to several variants can accommodate inner components adapted for example to the appropriate peak cylinder pressure of a particular variant for example a diesel and a gasoline derivative. Furthermore different inner components may be optimized for a range of power outputs associated with a similar engine architecture, for example standard, turbocharged and supercharged variants.

Furthermore the outer component may partly form ancillary devices such as supercharger, bell housing, gearbox casing, alternator and the like, for example by integrating the individual casings thereof in a unitary aluminium die casting. This arrangement can save further cost and weight.

A particular advantage of at least some implementations of the invention is that the composite block can be wide in the transverse dimension with little or no weight penalty. This is because the usual internal webs between the cylinders and outer face of the block are not necessary. The crankcase may have a barrel like appearance. Thus a wide and inherently stiff construction is possible with little internal structure to resist movement of air as a consequence of piston reciprocation and crankshaft rotation. In particular conventional casting webs linking the cylinders and outer face of the engine block are omitted so that the cylinders are substantially self supporting between the combustion chamber and crankcase ends thereof. The internal space between the inner and outer components may thus be substantially unobstructed between the cylinders and the casing.

The outer component can be relieved of most functions associated with generation of power and transmission of torque, so that it becomes an enclosure for the moving parts and for lubricating oil, and a mounting for the engine itself and for auxiliaries mounted on the engine. The spaces between the inner and outer component may be used to accommodate apparatus normally fitted externally, such as an oil separator for crankcase oil mist.

The inner and outer components preferably define mutually close fitting abutments so as to ensure that the components lie in register; such abutments can be relatively easily machined due to the inherent exposure of external and internal faces, and can control position longitudinally, and transversely, in addition to determining insertion depth. Registration of components can be locked after insertion by suitably placed dowels and/or screw threaded fasteners A torque reaction path of the composite cylinder block typically extends from the inner component to a region of the outer component adapted for connection to the vehicle body, thus ensuring that the load path is substantially direct.

In another embodiment the inner component includes a peripheral transverse flange for abutment with a mounting face of the outer component. In this embodiment the peripheral flange is substantially continuous on either side of the cylinder bore(s) in the direction of the crankshaft axis, and may additionally be substantially continuous and connected across one or both ends of the cylinder at the nose and crankshaft output end. Such flange(s) permit connection of the inner and outer components by screws, for example machine screws passing through flange apertures to engage threaded recesses of the outer component.

Both inner and outer component may define bosses or locally thickened locations adapted to receive screws or bolts.

According to a still further aspect of the invention for which protection is sought, there is provided a method of manufacturing a cylinder block comprising forming a first component for defining at least one cylinder bore, forming a second component for defining, at least in part, a crankcase, inserting the first component into the second component and rigidly attaching the first and second components together.

The Statements of Invention refer generally to a single cylinder engine. However it will be understood that the invention is also applicable to multi-cylinder engines in which the cylinder bores are defined by the inner component. The invention also extends to a composite cylinder block with a plurality of inner components within a single outer component.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments, unless there is incompatibility of features.

DESCRIPTION OF EMBODIMENTS OF THE INVENTION

The present invention will now be described, by way of example only, with reference to the accompanying drawings in which:—

FIG. 1 is a schematic perspective view of the inner core of an engine, defining cylinders and crankshaft center line, with pistons and rotating components;

FIG. 2 corresponds to FIG. 1 and shows the assembly of FIG. 1 within a casing comprising upper crankcase and cylinder jacket;

Figure 1:
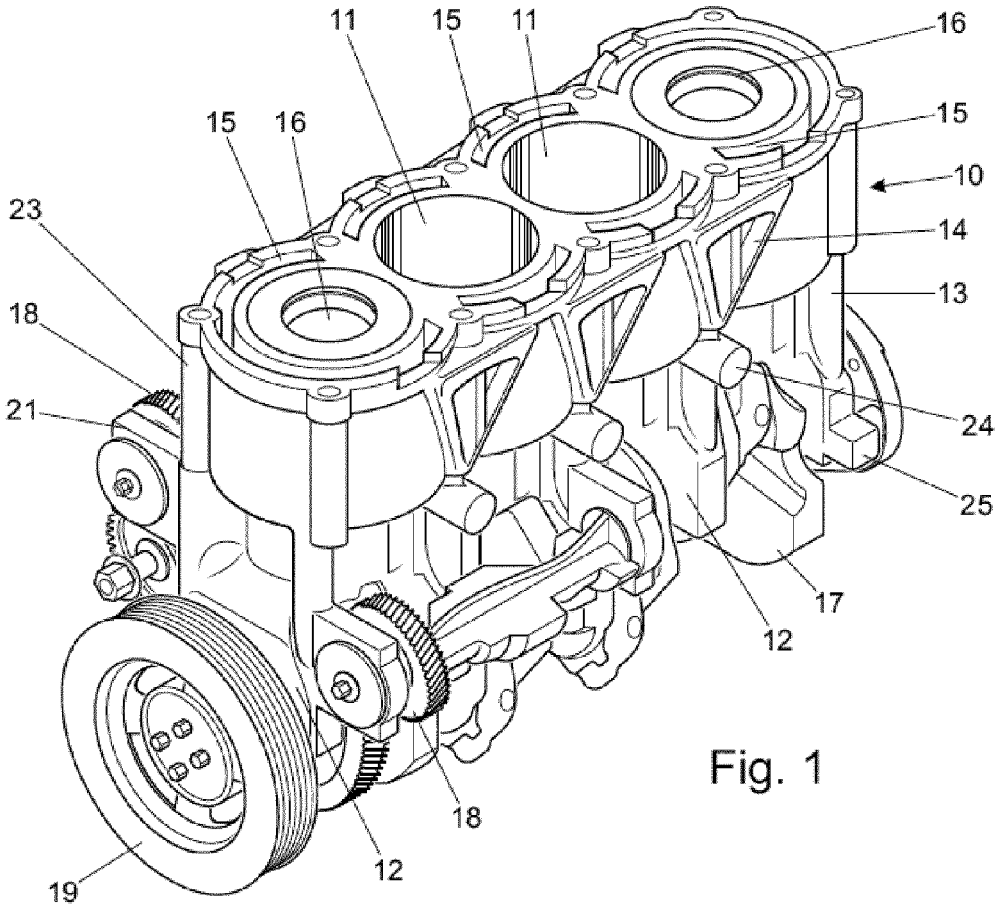

With reference to FIG. 1, an inner component provided by a unitary core (10) of an in-line four cylinder engine defines the cylinders (11) and main bearing housings (12). Typically a main bearing will be provided at either end of the crankshaft, and between each cylinder pair, but fewer bearings are possible. The material of the core may be for example an aluminium alloy or cast iron.

In the arrangement depicted, material content of the core (10) is minimized and thus pillars (13) connect the cylinders (11) and main bearing housings (12), and reinforcing ribs (14) are provided in the regions between the cylinders. The nature and form of the connecting and stiffening sections can be optimized by any known means according to the required duty, but it will be understood that internal and external surfaces of the core are generally accessible for machining. In the illustrated embodiment the cylinders are provided with an integral coolant passages (15) to be supplied via a cylinder head (not shown). However a coolant jacket could for example be provided by an assembled or welded component, in whole or in part, or be omitted if cylinder cooling is provided by other means. For example, the barrel like crankcase allows space for oil spray cooling onto the outside faces of the cylinders, from spray nozzles arranged between the inner and outer components.

Although not clearly shown in FIG. 1, the main bearing housings (12) depend individually from the upper portion which defines the cylinder bores.

FIG. 1 also illustrates pistons (16), crankshaft (17), balancer shafts and drive gear (18) and a multi-vee drive pulley (19). Protruding portions (21) of the core (10) provide bearing housings for the balancer shafts, and are an example of support for auxiliary moving components which can be provided on the core.

A particular advantage of the core is that cylinder axes and crankshaft center line can be precisely aligned, along with associated moving components such as the balancer shafts. Thus misalignment of axes due to assembly of components can be obviated.

The core can also provide fixing locations for relatively fixed internal components.

The core (10) avoids deep internal recesses and hollows which characterize conventional cylinder block construction, in which the outer cylinder block wall is the outermost surface.

Also illustrated in FIG. 1 are thickened ribs (23) for receiving cylinder head screws, and external bosses 24, 25 for engaging an outer component of the cylinder block.

Figure 2:
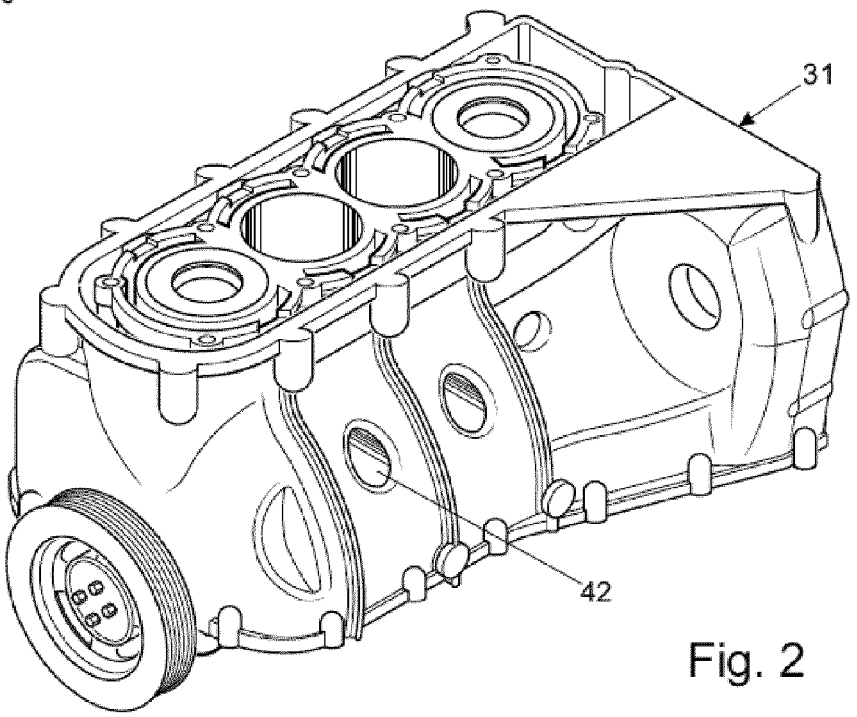

FIG. 2 illustrates the assembly of FIG. 1 inserted into an outer component provided by an enclosure (31) comprising a cylinder jacket and upper crankcase. For the purposes of illustration, the inner core assembly (with pistons, connecting rods, crankshaft etc.) is shown inserted, but it will be appreciated that the bare core (10) could be inserted into the enclosure (31) first, and the moving components added later.

The inner core (10) is generally at a spacing from the enclosure (31) but suitable centralizing and locating features can be provided, such as by bosses (24, 25) fitting against corresponding bosses of internal faces of the enclosure. Such features, if provided, are for positioning purposes, are few, and need not add significant mass or material.

As is clear from FIG. 2, the enclosure (31) can be wide throughout the axial length thereof, thus significantly increasing stiffness thereof compared with a narrow equivalent. The internal spaces are much less obstructed than those of a narrow block, as will be further described with reference to FIG. 4.

The core (10) and enclosure (31) are rigidly attached by suitable means. For example if of compatible materials, the core and enclosure may be welded. Alternatively the components may be fixed by screws or bolts, for example via the cylinder head as a linking component.

Figure 3:
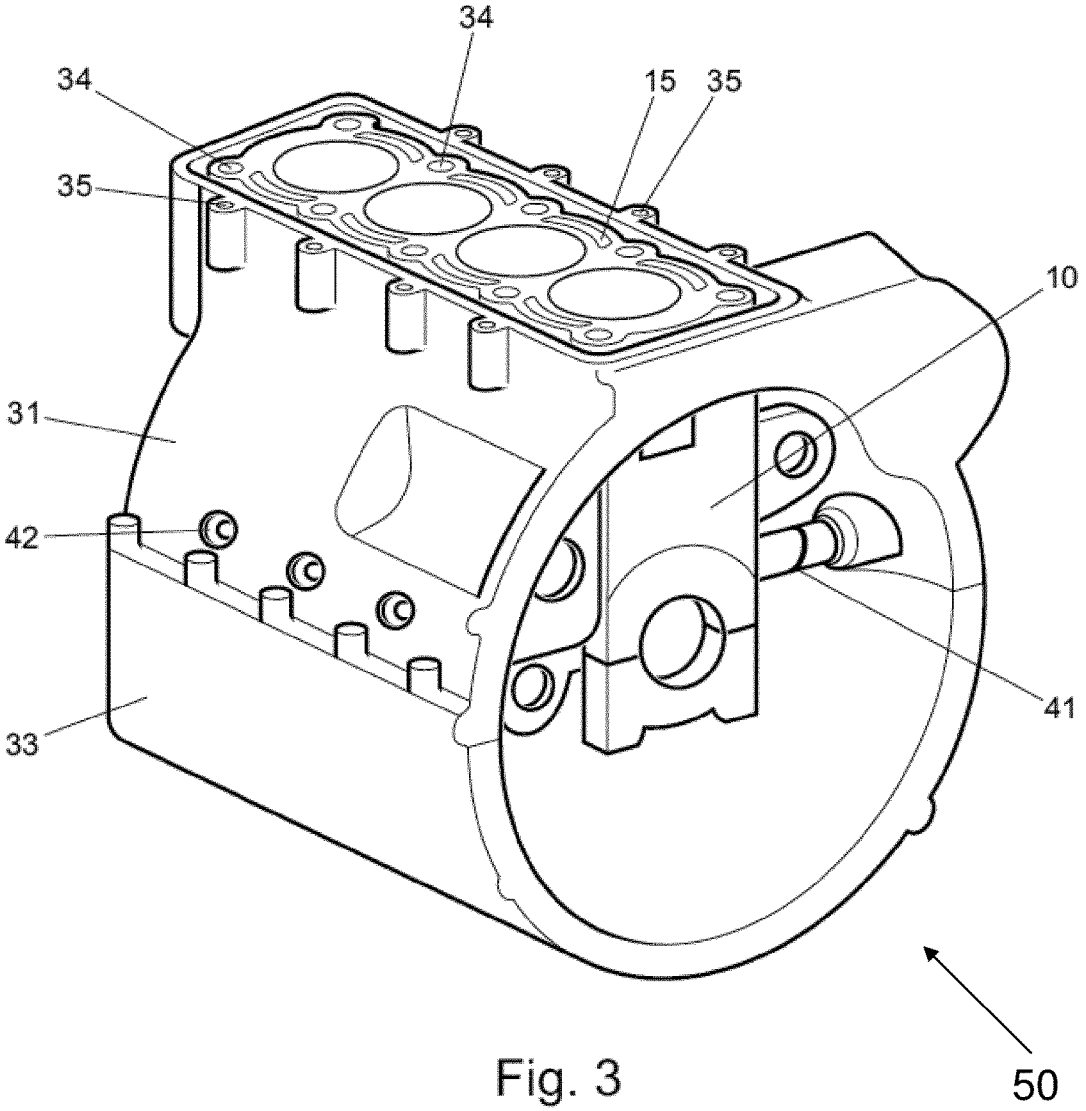
FIG. 3 is a flywheel end view of an assembly of similar appearance to FIG. 2, but without pistons or rotating components.

FIG. 3 shows a perspective view of a short engine assembly comprising the core 10 of FIG. 1 and the enclosure 31 of FIG. 2. The view is taken from a flywheel end of the assembly, showing a crankcase 50 defined at least in part by the volume enclosed by an oil pan 33 and enclosure 31.

Figure 4:
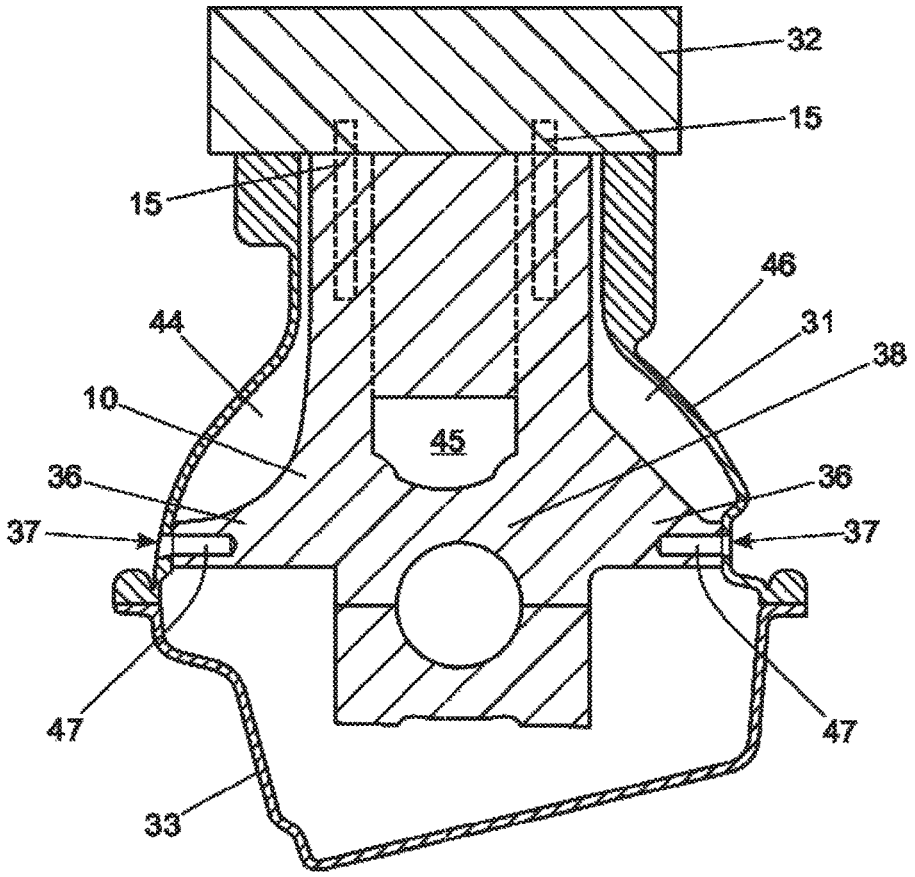
FIG. 4 is an example section through an assembly corresponding to FIG. 3, with schematic cylinder head.

FIGS. 3 and 4 show an arrangement of bare components and consisting of a unitary core (10) and an enclosure (31); FIG. 4 illustrates a schematic cylinder head (32). Features common to FIGS. 1 and 2 have like reference numerals. The oil pan (33) is also depicted, though it will be appreciated that this component is in use attached after insertion of the internal moving components of the engine.

With reference to FIG. 4, the cylinder head (32) is provided to hold the core (10) and enclosure (31) in a fixed rigid relationship. Thus, the cylinder head is typically provided with machine screws or bolts which pass through from the upper face to engage an array of threaded holes (34, 35) extending around the periphery of the core (10) and enclosure (31). The arrangement of holes (34, 35) is shown for illustration purposes, and more or less could be provided depending on the design duty. A conventional cylinder head gasket (not shown) is provided. Dowels or shouldered bolts may be provided to hold the components in a precise relationship. Through bolts or studs extending from the cylinder head to the bedplate are also possible, such fixings extending through or past the core (10).

The block and core are thus unitized at the head face upon assembly. It will be appreciated that a bare core, or an inner core assembly, of the kind illustrated in FIG. 1 can be inserted into the enclosure (31), depending upon the preferred assembly sequence.

As noted above the inner core (10) and enclosure (31) may have mutual location or abutment faces to permit correct positioning thereof. Thus in FIG. 4, transverse shoulders (36) extend to internal contact faces of the enclosure from the main bearing region (38). These shoulders need not be provided in the plane of the main bearings, nor at every such plane, nor in opposition to one another.

In an alternative, the lower main bearing supports may be provided together on a deck plate, which extends transversely to meet a downwardly extended enclosure (31) (not shown). In this arrangement the shoulders (36) are no longer necessary, and a greater volume is thus provided within the crankcase above the crankshaft center line.

In addition to locating the core (10) within the enclosure (31), the shoulders (36) may also provide a path from the inner core to the engine mountings for resisting engine torque. For this purpose the shoulders (36) should preferably be provided below the cylinders, and generally transversely to the crankshaft center line. Additional support may be provided in the region of the cylinder wall of the core (10), in order to resist transverse piston thrust. As is well understood, owing to the unidirectional rotation of four-stroke engines, support against crankshaft loads and piston thrust is required substantially on one side of an engine, so that the required support may not be provided equally on both sides. Such considerations may not apply for two-stroke or other kinds of combustion cycle to which the invention can be applied. In particular in a two-stroke variant, the space between the core and enclosure may be used to confine the crankcase charge induced by engine rotation.

In order to improve stiffness of the assembly of core and enclosure, screw fixings may be provided at touching points, as illustrated by reference numerals (37). Cross-bolts in the form of set screws inserted from the outside into threaded holes (47) of the core (10) are one possibility, and may include a plane shank portion so as to precisely locate a corresponding hole of the enclosure (31) with respect to the core (10). The core and enclosure may alternatively be placed in register by dowels and secured by screw fixings—or be connected via shouldered bolts having a dowel diameter for engaging a precise through hole of the enclosure.

In the embodiment of FIG. 4, such fixings have the additional function of holding the core and enclosure in precise pre-determined relationship upon removal of the cylinder head.

The touching points between the core and enclosure are typically machined surfaces sized for a sliding or interference fit. The transverse location of the contact face(s) and profile of the adjacent structure is selected according to design requirements and available space. Accordingly the shoulders could extend inwardly wholly from the enclosure (31), or suitable shoulders could extend part-way from core (10) and enclosure (31), as illustrated by the contact face (41) of FIG. 3. One or more machined abutments may determine insertion depth of the core or core assembly within the enclosure.

FIGS. 2 and 3 also indicate that contact faces of the enclosure could have an internal mouth (42) in order to recess cross-bolts, and provide additional wall stiffness in the connection area.

Figure 5:
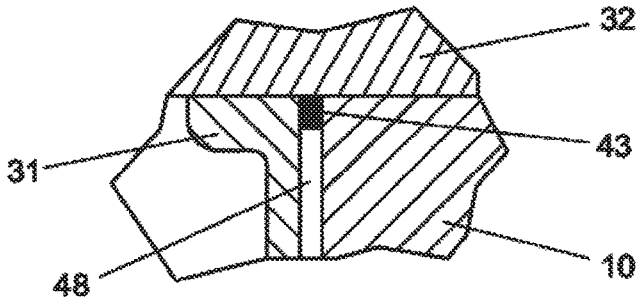
FIG. 5 is a scrap section showing a welded connection.

As noted above the core and enclosure can be welded, or otherwise permanently attached, if of compatible material. Such a weld (43) may for example lie in the mouth (48) of the space between the core and enclosure just below the cylinder head face, as illustrated in FIG. 5. Alternatively a proud weld could be skimmed so as to give a flat head mounting face across both core and enclosure.

FIG. 4 clearly shows that substantial internal voids or spaces and apertures 44-46 can be formed in and around the core (10) so as to permit movement of the crankcase gases. As a result, windage caused by reciprocal piston movement can be substantially eliminated.

Figure 6:
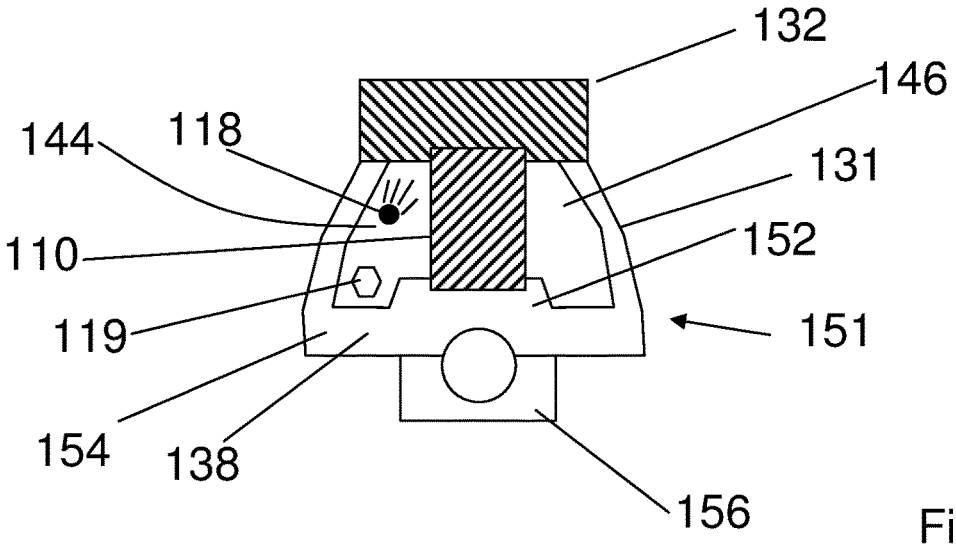
FIG. 6 is a schematic cross-section through another embodiment of the invention.

FIG. 6 shows an alternative embodiment of the composite cylinder block of the present invention. In the Figure, an inner component, in the form of an inner core (110) defines a cylinder bore. An outer component provided by an enclosure (131) defines a barrel-like upper crankcase (151), and unitary upper bed plate (154) defining the cylinder side main bearing supports of a crankshaft (not shown). A cylinder head (132) unitizes the inner and outer components so that the cylinder block is a composite.

Typically the cylinder head (132) may be attached to both the inner component and to the outer component by screw-threaded fasteners engageable in locally thickened portions thereof.

The inner component may be located within the outer component by suitable lateral ribs or bosses, and/or by axial features such as the upstanding crankcase collar 15. The inner component may also be recessed within the cylinder head as illustrated, to give a close-fitting upper location.

In FIG. 6, one separate main bearing cap 156 is illustrated; in practice it will be understood that such caps are required for each main bearing location, and in one embodiment of the invention these caps are integrated into a lower bed plate (not shown), which may extend transversely across substantially the entire width of the upper bed plate 154.

Typically the inner component is formed at least in part from cast iron, and the outer component of cast aluminium. This arrangement provides a substantial weight saving in a stiff unitized structure.

As will be clear from FIG. 6, the usual lateral ribs, formed by the runners of a conventional casting, are absent so that the spaces 144, 146 on either side of the cylinder are relatively large, and unobstructed. These spaces are of the order of the cylinder bore, or larger. The wide barrel-like upper crankcase (151) thus gives a stiff structure with reduced internal windage in use.

It will be understood that the separate inner and outer components may be finish machined on both internal and external faces. This allows possibilities of weight saving and surface finishing which are not possible with a conventional unitary engine block.

The spaces 144, 146 may be utilized, at least in part, for other engine components. For example cylinder cooling may be provided by oil spray, illustrated schematically at 118, and internal mounting of engine ancillaries 119 becomes possible—the latter may comprise for example a pump.

The inner component 110 may incorporate a coolant jacket (not shown) around the cylinder, and connecting with coolant supply and return passages of the cylinder head 132. The outer component (131) may comprise integrated engine mountings and the like (not shown for clarity).

Figure 7:
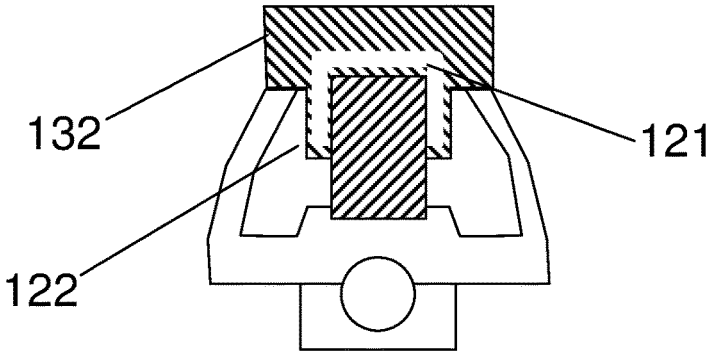
FIG. 7 is a schematic cross-section through a further embodiment of the invention.

The variant of FIG. 7 differs by the provision of a coolant jacket (121) as an annular close-fitting projection (122) of the cylinder head (132). Such an arrangement can provide effective cooling of the working part of the cylinder whilst obviating a gasket to seal the cylinder head (132) to the inner component (110). Other options, as described in relation to FIG. 6 remain possible, though it will be understood that spray cooling may not be necessary if a coolant jacket (121) is to be used.

Figure 8:
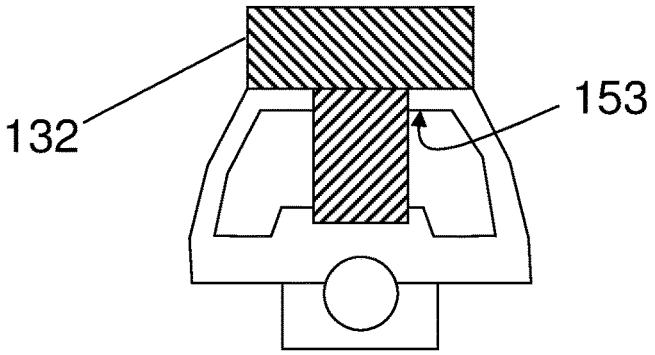
FIG. 8 is a schematic cross-section through still a further embodiment of the invention.

In FIG. 8, the outer component (131) extends inwardly toward the cylinder at 153 so as to provide an upper location for the inner component (110). This arrangement obviates the need for a locating portion of the cylinder head (132), as illustrated in FIGS. 6 and 7. The cylinder head (132) and outer component (131) are typically located in the transverse plane by suitably placed dowels or fitted bolts (not shown). In the FIG. 8 embodiment it will be appreciated that the inner component (110) may be a press or interference fit within the outer component (131).

As illustrated in FIGS. 6-8, the inner component (110) has lateral location provided by the outer component (131); this lateral location may be continuous about the inner component (110) or may be constituted by a sufficient number of spaced abutments.

It will also be understood that typically the inner and outer components are of different materials having different melting temperatures. Accordingly one component may be fixed relative to another component by form locking during casting of the lower melting point material.

This application describes an engine or engine block having an inner component defining a cylinder bore and an outer component defining, at least in part, a crankcase for a crankshaft of the engine, the inner component being inserted into the outer component and rigidly attached thereto. In one embodiment, the inner component defines, at least in part, a main bearing support for a crankshaft. In other embodiments, the outer component defines, at least in part, a main bearing support for the crankshaft. Each of these disclosed embodiments achieves the aims stated hereinabove and thus involve a common inventive concept.

This application claims priority from UK patent application no. GB 1019356.3, filed 16 Nov. 2010, the entire contents of which are expressly incorporated herein by reference.

The invention claimed is:

1. A cylinder block for an internal combustion engine, the block comprising an inner component that is a unitary core separate from an outer component, the inner component comprising a cylinder bore and the outer component defining, at least in part, a crankcase, the inner component being inserted in the outer component and being rigidly attached thereto, and wherein the inner component comprises, at least in part, a main bearing housing for a crankshaft, and wherein the inner component is provided with an integral coolant passage configured to receive coolant from or supply coolant to a cylinder head, the coolant passage defined solely by the unitary core, whereby coolant flowing through the integral coolant passage is isolated from the outer component such that the coolant is separated from and cannot flow into contact with the outer component.

2. The cylinder block of claim 1, wherein the inner component is inserted in the outer component to define a clearance therebetween.

3. The cylinder block of claim 2, wherein the inner and outer components define a void therebetween, and said inner component is adapted for mounting of moving parts on the exterior thereof in said void.

4. The cylinder block of claim 1, wherein the inner component is wholly within the outer component.

5. The cylinder block of claim 1, wherein the outer component extends below a center line of the crankshaft.

6. The cylinder block of claim 5, wherein the inner and outer components include mating surfaces adapted to maintain the inner and outer components in register transversely and longitudinally of the center line of the crankshaft.

7. The cylinder block of claim 5, wherein the inner and outer components are coupled transversely substantially at the center line of the crankshaft.

8. The cylinder block of claim 1, wherein the outer component is in the form of a continuous skirt.

9. The cylinder block of claim 1, and further including main bearing caps connected to the inner component and comprising a bed plate.

10. The cylinder block of claim 1, wherein the inner and outer components are connected by screw-threaded fasteners.

11. The cylinder block of claim 1, wherein the inner and outer components are indirectly connected.

12. The cylinder block of claim 11, wherein the outer component and inner component are connected by a cylinder head.

13. The cylinder block of claim 12, wherein the cylinder head holds the unitary core and the outer component in a fixed rigid relationship.

14. The cylinder block of claim 1 incorporated in a multi-cylinder internal combustion engine.

15. The cylinder block of claim 1 is incorporated in an engine of a vehicle.

16. A reciprocating piston internal combustion engine comprising a cylinder block and a cylinder head, the cylinder block comprising an inner component that is a unitary core separate from an outer component, the inner component comprising a cylinder bore and the outer component defining, at least in part, a crankcase, the inner component being inserted in the outer component and being rigidly attached thereto, and wherein the inner component comprises, at least in part, a main bearing housing for a crankshaft, and wherein the inner component is provided with an integral coolant passage configured to receive coolant from or supply coolant to a cylinder head, the coolant passage defined solely by the unitary core, whereby coolant flowing through the integral coolant passage is isolated from the outer component such that the coolant is separated from and cannot flow into contact with the outer component, and the cylinder head indirectly attaching the inner component to the outer component to define a clearance therebetween.

17. An engine according to claim 16, and including a moving part mounted on the exterior of said inner component within said clearance.

18. An engine according to claim 16, wherein the inner and outer components are coupled transversely at the thrust side of said cylinder block.

19. An engine according to claim 18, wherein said inner and outer components are connected by opposed screw fixings substantially at a center line of the crankshaft.

* * * * *